US006330419B1

(12) United States Patent
Sano et al.

(10) Patent No.: US 6,330,419 B1
(45) **Date of Patent: *Dec. 11, 2001**

(54) SHEET DISCHARGE ROTARY BODY FOR USE IN IMAGE FORMING APPARATUS

(75) Inventors: Atsushi Sano, Shizuoka-ken; Masanobu Kanoto, Mishima; Makoto Nishigaki, Odawara, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/296,564

(22) Filed: Apr. 22, 1999

(30) Foreign Application Priority Data

Apr. 28, 1998 (JP) ..... 10-132633

(51) Int. Cl.[7] ..... G03G 15/20

(52) U.S. Cl. ..... 399/322; 219/216; 399/328; 399/68

(58) Field of Search ..... 219/216, 600; 399/320, 322, 324, 328, 396, 400, 405, 67, 68, 122

(56) References Cited

U.S. PATENT DOCUMENTS

| | | | | |
|---|---|---|---|---|
| 4,309,591 | | 1/1982 | Kanoto et al. | 219/216 |
| 4,334,946 | | 6/1982 | Kanoto | 156/352 |
| 4,589,654 | | 5/1986 | Kanoto | 271/314 |
| 4,750,729 | | 6/1988 | Kanoto et al. | 271/162 |
| 5,422,710 | * | 6/1995 | Shirasaka et al. | 399/322 |
| 5,442,429 | * | 8/1995 | Bartholmae et al. | 399/322 |
| 5,499,089 | * | 3/1996 | Tsukamoto et al. | 399/328 |
| 5,909,607 | | 6/1999 | Kikuchi et al. | 399/124 |
| 6,026,273 | * | 2/2000 | Kinouchi et al. | 399/328 |

FOREIGN PATENT DOCUMENTS

| | | |
|---|---|---|
| 0 555 883 | 2/1993 | (EP) . |
| 64-28159 | 1/1989 | (JP) . |
| 7-144786 | 6/1995 | (JP) . |
| 9-281827 | 10/1997 | (JP) . |
| 90-2133 | 2/1990 | (KR) . |
| 91-3462 | 2/1991 | (KR) . |
| 91-11201 | 7/1991 | (KR) . |
| 92-10364 | 6/1992 | (KR) . |

* cited by examiner

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

The present invention has an object to provide a fixing apparatus which is configured to easily facilitate to prevent a semi-melted developer on a recording medium from adhering to surfaces of upper rotary bodies and an image forming apparatus which is equipped with the fixing apparatus.

This object is accomplished by configuring the fixing apparatus so that a sheet which has been subjected to a fixing treatment receives conveying forces from pinch rollers having rotating axial directions which are on a plane in parallel with a surface of the sheet and inclined at a predetermined angle θ relative to rotating axial directions of a fixing roller and a press roller.

39 Claims, 11 Drawing Sheets

SHEET DISCHARGE ROTARY BODY FOR USE IN IMAGE FORMING APPARATUS

BACKGROUND OF THE INVENTION

1. Field of the Invention

The present invention relates to a fixing apparatus which performs a fixing treatment of a recording medium bearing an image which has not been fixed and an image forming apparatus which is equipped with the fixing apparatus.

2. Related Background Art

There is conventionally known and put to practical use a fixing apparatus 100 equipped, as shown in FIG. 11, with a fixing rotary body 102 which is in contact with a non-fixed image bearing surface of a recording medium 101, a press rotary body 103 which is in pressure contact with the fixing rotary body 102 through the recording medium 101, and a plurality of sheet discharge rotary body pairs 104 which nip, convey and discharge the recording medium 101 subjected to a fixing treatment out of a fixing apparatus main body: each of the sheet discharge rotary body pairs 104 including an upper rotary body 105 which is to be in contact with the surface of the recording medium 101 and a lower rotary body 106 which is in pressure contact with the upper rotary body 105 through the recording medium 101.

FIG. 11 is a schematic front view showing an outline of a configuration of the fixing apparatus 100.

Speaking concretely of the fixing apparatus 100, the recording medium 101 which bears a non-fixed image is subjected to the fixing treatment while passing between the fixing rotary body 102 and the press rotary body 103, and nipped and conveyed by the plurality of upper rotary bodies 105 and the lower rotary bodies 106 which are rotating in the same direction as the fixing rotary body 102 and the press rotary body 103, thereby being discharged out of the fixing apparatus main body.

Furthermore, since the upper rotary bodies 105 which are brought into contact with a developer beared by the recording medium 101 which has been subjected to the fixing treatment, a fluoroplastic is used as a surface material for the upper rotary bodies 105 to prevent the developer from adhering to surfaces of the upper rotary bodies 105.

In the recent years where the speeding up of an image forming process is progressed, a passage from a fixing nip formed between the fixing rotary body and the press rotary body to a sheet discharge nip formed between the upper rotary body and the lower rotary body tends to be shortened as a measure to speed the an image forming process.

However, the conventional fixing apparatus 100 in which rotating shafts of the upper rotary bodies 105 are in parallel with rotating shafts of the fixing rotary body 102 and the press rotary body 103 as shown in FIG. 11 can hardly prevent a semi-melted developer on the recording medium 101 having been subjected to the fixing treatment from adhering to surfaces of the upper rotary bodies 105 even if a fluoroplastic is adopted as the surface material for the upper rotary bodies 105.

In particular, there is a tendency to use developers which have low melting points as a measure to speed the image forming process and it is extremely difficult to prevent such developers having low melting points from adhering to the surfaces of the upper rotary bodies.

SUMMARY OF THE INVENTION

In view of the circumstances described above, a primary object of the present invention is to provide a fixing apparatus which is capable of facilitating to prevent a semi-melted developer on a recording medium from adhering to surfaces of upper rotary bodies or an image forming apparatus which is equipped with the fixing apparatus.

The present application makes it possible to accomplish the object described above by a first invention, which is a fixing apparatus configured to perform a fixing treatment of a recording medium bearing a non-fixed image on one surface thereof by heating the recording medium with a heating body while passing the recording medium between a fixing rotary body and a press rotary body which are in pressure contact with each other and rotatable, and comprising pairs of sheet discharge rotary bodies which are in pressure contact with each other through the recording medium, and nip and convey the recording medium after the fixing treatment to discharge the recording medium out of a fixing apparatus main body: the pairs of paper discharge bodies including upper rotary bodies to be in contact with one surface of the recording medium and lower rotary bodies to be in contact with the other surface of the recording medium, wherein at least the upper rotary bodies are set to apply conveying forces to the recording medium in directions which are on a plane in parallel with the surface of the recording medium and inclined relative to a recording medium conveying direction between the fixing rotary body and the press rotary body.

Furthermore, the present application makes it possible to accomplish the object described above by a second invention, wherein a recording medium conveying speed between the upper rotary bodies and the lower rotary bodies is set higher than a recording medium conveying speed between the fixing rotary body and the press rotary body in the first invention according to the present application.

Furthermore, the present application makes it possible to accomplish the object described above by a third invention, wherein rotating axial directions of the upper rotary bodies are set in directions which are on a plane in parallel with a surface of the recording medium and inclined relative to axial directions of rotating shafts of the fixing rotary body and the press rotary body in the first invention or the second invention according to the present application.

Furthermore, the present application makes it possible to accomplish the object described above by a fourth invention, wherein a through bore which has an inside diameter continuously enlarged from an end to the other end in a rotating axial direction is formed in each upper rotary body, a shaft body which rotatably supports the upper rotary body is inserted into the through bore and the shaft body has an outside diameter which is smaller than a small diameter of the through bore in the first invention or the second invention according to the present application.

Furthermore, the present application makes it possible to accomplish the object described above by a fifth invention, wherein each upper rotary body is configured to have an outside diameter which is continuously enlarged from an end to the other end in a rotating axial direction in the first invention or the second invention according to the present application.

Furthermore, the present application makes it possible to accomplish the object described above by a sixth invention, wherein the fixing apparatus comprises a plurality of sheet discharge rotary body pairs, and the upper rotary bodies and the lower rotary bodies are arranged symmetrically or nearly symmetrically with regard to a center of the fixing rotary body and the press rotary body in their rotating axial directions in the first invention through fifth invention according to the present application.

Furthermore, the present application makes it possible to accomplish the object described above by a seventh invention, wherein the upper rotary body is configured to have a form which has smooth outer circumferential surfaces at both ends in its rotating axial direction in the first to sixth inventions according to the present application.

Furthermore, the present application makes it possible to accomplish the object described above by an eighth invention, wherein a surface of the upper rotary body is made mainly of a fluoroplastic material in the first to seventh inventions according to the present application.

Furthermore, the present application makes it possible to accomplish the object described above by a ninth invention, wherein the fixing rotary body is an endless belt of heat-resistant film, the heating body is a ceramic heater including a heating member which is disposed on one surface of a substrate made mainly of a ceramic material to generate heat while receiving an electric power from an electric power source and a temperature detecting body which is disposed in contact with or close to the other surface of the substrate in the first to eighth inventions according to the present application.

Furthermore, the present application makes it possible to accomplish the object described above by a tenth invention, which is an image forming apparatus configured to form a visible image by developing a latent image formed and borne on a latent image bearing member with a developer, transfer the visible image to one surface of a recording medium so as to form a non-fixed image on the one surface and record the non-fixed image as a fixed image on the recording medium, and equipped with the fixing apparatus defined as the first invention according to the present application.

Furthermore, the present application makes it possible to accomplish the object described above by an eleventh invention, wherein a recording medium conveying speed between upper rotary bodies and lower rotary bodies is set higher than a recording medium conveying speed between the fixing rotary body and the press rotary body in the tenth invention according to the present application.

Furthermore, the present application makes it possible to accomplish the object described above by a twelfth invention, wherein rotating axial directions of the upper rotary bodies are set in directions on a plane in parallel with a surface of the recording medium and inclined relative to axial directions of the rotating shafts of the fixing rotary body and the press rotary body in the tenth or eleventh invention according to the present application.

Furthermore, the present application makes it possible to accomplish the object described above by a thirteenth invention, wherein an upper rotary body has a through bore which is formed to have an inside diameter continuously enlarged from an end to the other end of its rotating axial direction, a cylindrical shaft body which rotatably supports the upper rotary body is inserted into the through bore and the shaft body has an outside diameter not larger than a small diameter of the through bore in the tenth invention or the eleventh invention according to the present application.

Furthermore, the present application makes it possible to accomplish the object described above by a fourteenth invention, wherein an upper rotary body is configured to have a form which has an outside diameter continuously enlarged from one end to the other end of its rotating axial direction in the tenth invention or the eleventh invention according to the present application.

Furthermore, the present application makes it possible to accomplish the object described above by a fifteenth invention, wherein the image forming apparatus is equipped with sheet discharge rotary bodies in a plurality of pairs, and the upper rotary bodies and lower rotary bodies are arranged symmetrically or nearly symmetrically with regard to a center of rotating shafts of the fixing rotary body and the press rotary body in their rotating axial directions in the tenth invention to the fourteenth invention according to the present application.

Furthermore, the present application makes it possible to accomplish the object described above by a sixteenth invention, wherein an upper rotary body is configured to have smooth outer circumferential surfaces at both ends in a direction of its rotating shaft in the tenth invention to the fifteenth invention according to the present application.

Furthermore, the present application makes it possible to accomplish the object described above by a seventeenth invention, wherein surfaces of the upper rotary bodies are made mainly of a fluoroplastic material in the tenth invention to the sixteenth invention according to the present application.

Moreover, the present application makes it possible to accomplish the object described above by an eighteenth invention, wherein the fixing rotary body is an endless belt of heat-resistant film, the heating body is a ceramic heater including a heating member which is disposed on one surface of a substrate made mainly of a ceramic material to generate heat while receiving an electric power from an electric power source, and a temperature detecting body is disposed in contact with or close to the other surface of the substrate in the tenth invention to the seventeenth invention according to the present application.

Speaking concretely of the first invention according to the present application, conveying forces in directions which are on the plane in parallel with the surface of the recording medium and inclined from the recording medium conveying direction between the fixing rotary body and the press rotary body are applied at least from the upper rotary bodies to the recording medium which has been subjected to the fixing treatment while passing between the pair of sheet discharge rotary bodies.

In the second invention according to the present application, the recording medium which enters between the pair of sheet discharge rotary bodies is nipped and conveyed at a speed higher than the recording medium conveying speed between the fixing rotary body and the press rotary body.

In the third invention according to the present application, upper rotary bodies which have rotating axial directions in directions on the plane in parallel with the surface of the recording medium and inclined from axial directions of the rotating shafts of the fixing rotary body and the press rotary body apply conveying forces in directions perpendicular to the rotating axial directions to the recording medium which has been subjected to the fixing treatment while passing between the pair of sheet discharge rotary bodies.

In the fourth invention according to the present application, upper rotary bodies each of which has a through bore formed therein so as to have an inside diameter continuously enlarged from one end to the other end in its rotating axial direction into which a shaft body having an outside diameter not larger than a small diameter of the through bore is inserted apply conveying forces in directions inclined toward the one end to the recording medium which has been subjected to the fixing treatment while passing between the pair of the sheet discharge rotary bodies.

In the fifth invention according to the present application, upper rotary bodies each of which is configured to have a outside diameter continuously enlarged from one end to the other end in its rotating axial direction apply conveying forces in directions inclined toward the one end to the recording medium which has been subjected to the fixing treatment while passing between the pair of sheet discharge rotary bodies.

In the sixth invention according to the present application, conveying forces which are symmetrical or nearly symmetrical with regard to the center in the rotating axial directions of the fixing rotary body and the press rotary body are applied from upper rotary bodies to the recording medium which has been subjected to the fixing treatment while passing between the sheet discharge rotary bodies.

In the seventh invention according to the present application, upper rotary bodies which are configured to have smooth outer circumferential surfaces at both the ends in rotating axial directions are brought into slide contact with the recording medium which has been subjected to the fixing treatment while passing between the sheet discharge rotary bodies.

In the eighth invention according to the present application, upper rotary bodies which have surfaces made mainly of a fluoroplastic material are brought into slide contact with the recording medium which has been subjected to the fixing treatment while passing between the pair of sheet discharge rotary bodies.

In the ninth invention according to the present application, the recording medium which bears the non-fixed image is subjected to the fixing treatment by heat from a ceramic heater while passing between a heat-resistant film and the press rotary body, and then nipped and conveyed by the pair of sheet discharge rotary bodies described in the first to eighth inventions according to the present application for discharge out of the fixing apparatus main body.

In the tenth invention according to the present application, conveying forces in directions which are on a plane in parallel with the surface of the recording medium and inclined from a recording medium conveying direction between the fixing rotary body and the press rotary body are applied at least from upper rotary bodies to the recording medium which has been subjected to the fixing treatment while passing between the sheet discharge rotary bodies.

In the eleventh invention according to the present application, the recording medium which enters between the sheet discharge rotary bodies is nipped and conveyed by pairs of sheet discharge rotary bodies at a speed higher than a recording medium conveying speed between the fixing rotary body and the press rotary body.

In the twelfth invention according to the present application, upper rotary bodies having rotating axial directions which are on a plane in parallel with the surface of the recording medium and inclined from the direction of the rotating axial directions of the fixing rotary body and the press rotary body apply conveying forces in directions perpendicular to the rotating axial directions of the upper rotary bodies to the recording medium which has been subjected to the fixing treatment while passing between the sheet discharge rotary bodies.

In the thirteenth invention according to the present application, upper rotary bodies each of which has a through bore formed therein so as to have an inside diameter continuously enlarged from one end to the other end in the direction of its rotating axial direction, and into which a shaft body configured to have an outside diameter not larger than a small diameter of the through bore is inserted apply conveying forces in the directions inclined toward the one end to the recording medium which has been subjected to the fixing treatment while passing between pairs of sheet discharge rotary bodies.

In the fourteenth invention according to the present application, upper rotary bodies each of which is formed to have an outside diameter continuously enlarged from one end to the other end in its rotating axial direction apply conveying forces in the directions inclined toward the one end to the recording medium which has been subjected to the fixing treatment while passing between the pair of sheet discharge rotary bodies.

In the fifteenth invention according to the present application, conveying forces which are symmetrical or nearly symmetrical with regard to a center in rotating axial directions of the fixing rotary body and the press rotary body are applied from upper rotary bodies to the recording medium which has been subjected to the fixing treatment while passing between the pair of sheet discharge rotary bodies.

In the sixteenth invention according to the present application, upper rotary bodies each of which is configured to have smooth outer circumferential surfaces at both ends in its rotating axial direction are brought into slide contact with the recording medium which has been subjected to the fixing treatment while passing between the pair of sheet discharge rotary bodies.

In the seventeenth invention according to the present application, upper rotary bodies which have surfaces made mainly of a fluoroplastic material are brought into slide contact with the recording medium which has been subjected to the fixing treatment while passing between the pair of sheet discharge rotary bodies.

In the eighteenth invention according to the present application, the recording medium which bears the non-fixed image is heated by a ceramic heater for the fixing treatment while passing between a heat-resistant film and the press rotary body, and then nipped and conveyed by the pair of sheet discharge rotary bodies described in the tenth invention to the seventeenth invention for discharge out of the fixing apparatus main body.

DETAILED DESCRIPTION OF THE PREFERRED EMBODIMENTS

Now, the preferred embodiments of the present invention will be described with reference to the accompanying drawings.

(First Embodiment)

A first embodiment of the present invention will be described first with reference to FIGS. 1 to 5.

Figure 1:
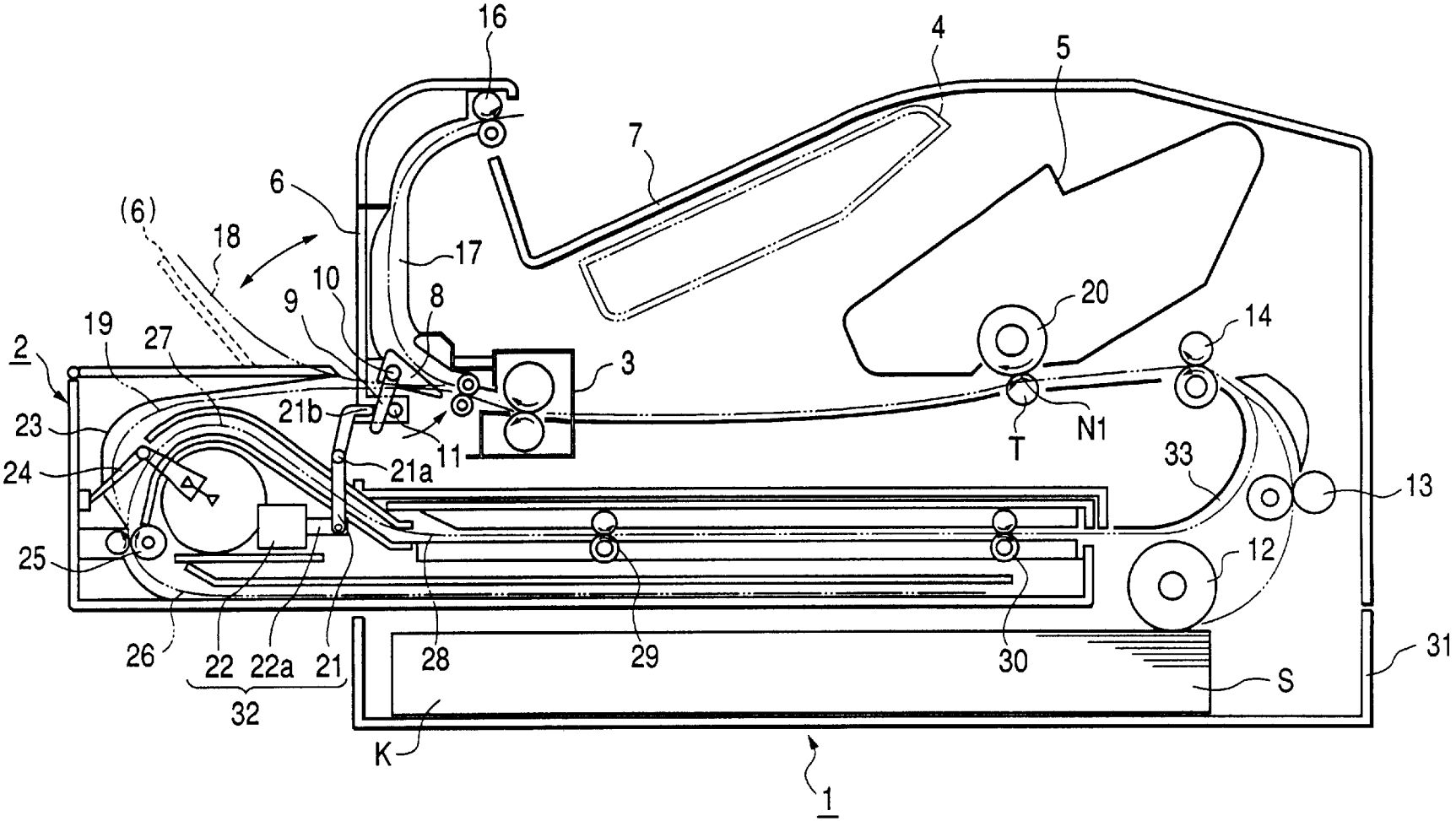
FIG. 1 is a schematic sectional view showing an outline of a configuration of a first embodiment of the image forming apparatus according to the present application.

FIG. 1 is a schematic sectional view showing an outline of a configuration of a laser printer 1 (hereinafter referred to as a printer 1) which is preferred as the first embodiment of the image forming apparatus.

The printer body 1 comprises, as shown in FIG. 1, a laser scanner 4 which is flickered by a laser in correspondence to image information provided from a host computer or the like (not shown) disposed outside the printer body 1, a process cartridge 5 which is detachably mounted in the printer body 1 and supports a rotatable latent image bearing member 20 in the shape of body of revolution, a cassette K which is detachably mounted in the printer body 1 and accommodates a sheet S as a recording medium, rotatable conveying rollers 12, 13, 14, 16 which bear the sheet S, a fixing apparatus 3 and so on.

Furthermore, detachably attached to the printer body 1 is a re-conveying unit 2 which is capable of re-conveying the sheet S having a surface which has been subjected to the fixing treatment to a transfer nip N1 formed between the latent image bearing member 20 and transfer means T disposed in opposition to the latent image bearing member 20.

Furthermore, the printer body 1 is equipped with a face-up tray 6 which is openably and closeably supported by a side surface of the printer body 1 and functions to stack the sheet S discharged out of the printer body 1 with its surface bearing a fixed image set upside, a face-down tray 7 which is disposed in an upper portion of the printer body 1 and functions to stack the sheet S discharged out of the printer body 1 with the surface bearing the fixed image set downside, and a flapper 8 which is swingably supported by the printer body 1 to swing in conjunction with opening/closing of the face-up tray 6: an interlocking lever 9 which interlocks opening/closing of the face-up tray 6 with swinging of the flapper 8 being attached to an end in an axial direction of a support shaft 10 which swingably supports the flapper 8.

In the first embodiment, the flapper 8 is positioned at a location indicated by solid lines when the face-up tray 6 is closed as indicated by solid lines in FIG. 1, whereby the sheet S is discharged through a sheet discharge path 17 and stacked on the face-down tray 7.

When the face-up tray 6 is opened as indicated by dashed lines in FIG. 1, the flapper 8 is positioned at a location indicated by dashed lines, whereby the sheet S is discharged through a sheet discharge path 18 and stacked on the face-up tray 6.

The re-conveying unit 2 is equipped with automatic switching means 32 including a switching lever 21 which is hinged to a support shaft 21*a*, a plunger 22, etc., an end of the switching lever 21 is coupled with an arm 22*a* which is extendably and shortenably supported by the plunger body 22, and a cam follower 21*b* which is to be brought into contact with the interlocking lever 9 is disposed on the other end of the switching lever 21.

Furthermore, the re-conveying unit 2 is equipped with a bringing guide 23 which brings the sheet S discharged out of the printer body 1 into the re-conveying unit 2, a switch back roller 25 which can rotate in both directions, sheet passage detecting means 24 which detects passage of the sheet S, a surface reverse path 26 for reversing a front surface and a reverse surface of the sheet S, re-conveying paths 27 and 28 for conveying the reversed sheet S toward the transfer nip N1, and re-conveying rollers 29 and 30 for re-conveying the sheet S.

Now, an image forming process only on one surface of the sheet S in the printer 1 will be described with reference to FIG. 1.

After the sheet S which is accommodated in the cassette K is supplied one by one into a conveying path 33 by the conveying roller 12 which is rotatingly driven counterclockwise upon start of the image forming process only on one surface of the sheet S, the sheet S is conveyed toward the transfer nip N1 by the conveying rollers 13 and 14.

Furthermore, a surface of the latent image bearing member 20 is irradiated with a flickering laser from the laser scanner 4 upon start of the image forming process only on one surface of the sheet S, whereby an electrostatic latent image corresponding to image information provided from outside the printer body 1 is formed on a surface of the latent image bearing member 20 and then the electrostatic latent image is made into a visible image with a developer supplied from developing means (not shown).

As the sheet S enters the transfer nip N1, the visible image which is formed and borne on the surface of the latent image bearing member 20 is transferred to the sheet S by transfer means T, whereby the non-fixed image corresponding to the image information provided from outside the printer body 1 is formed and borne on the sheet S.

The fixing apparatus 3 records a fixed image corresponding to the image information provided from outside the printer body 1 on the sheet S by performing the fixing treatment of the sheet S which bears the non-fixed image.

When the sheet S which has been subjected to the fixing treatment is to be discharged and stacked on the face-up tray 6, the face-up tray 6 which is closed at the location indicated by the solid lines is turned around the support shaft 11 and opened to the location indicated by the dashed lines and the flapper 8 positioned at the location indicated by a solid line swings to the location indicated by the dashed line around the support shaft 10 in conjunction with the opening of the face-up tray 6 to form the sheet discharge path 18 for the sheet S to the face-up tray 6, whereby the sheet S is discharged through the sheet discharge path 18 and stacked on the face-up tray 6 to complete the image forming process only on one surface of the sheet S.

When the sheet S which has been subjected to the fixing treatment is to be discharged and stacked on the face-down tray 7, on the other hand, the face-up tray 6 which is opened at the location indicated by the dashed lines is turned around the support shaft 11 to the closed location indicated by the solid lines and the flapper 8 which is positioned at the location indicated by the dashed line swings around the support shaft 10 to the location indicated by the solid line in conjunction with the closing of the face-up tray 6 to form the sheet discharge path 17 for the sheet S to the face-down tray 7, whereby the sheet S is discharged through the sheet discharge path 17 and stacked on the face-down tray 7 to complete the image forming process only on one surface of the sheet S.

For an image forming process on both surfaces of the sheet S, the face-up tray 6 is closed at the location indicated by the solid lines and the sheet S which has been subjected to the fixing treatment only on one surface is brought into the re-conveying unit 2 through a bringing path 19 which is formed by shortening the arm 22*a* and pressing the interlocking lever 9 with the cam follower 21*b,* thereby swinging the flapper 8 from the location indicated by the solid line to the location indicated by the dashed line.

The sheet S is conveyed to the surface reverse path 26 by rotating the switch back roller 25 counterclockwise upon detection of a passage of a leading end of the sheet S by the sheet passage detecting means 24, and the switch back roller 25 is rotated clockwise upon detection of a passage of a trailing end of the sheet S by the sheet passage detecting means 24, and furthermore the sheet S is re-conveyed to the transfer nip N1 through the re-conveying paths 27 and 28 as well as the conveying path 33, and thereby an image is formed on the other surface of the sheet S, and then is discharged and stacked on the face-down tray 7 to complete the image forming process on both surfaces of the sheet S.

Now, the fixing apparatus 3 used in the first embodiment will be described with reference to FIGS. 2 to 5.

Figure 2:
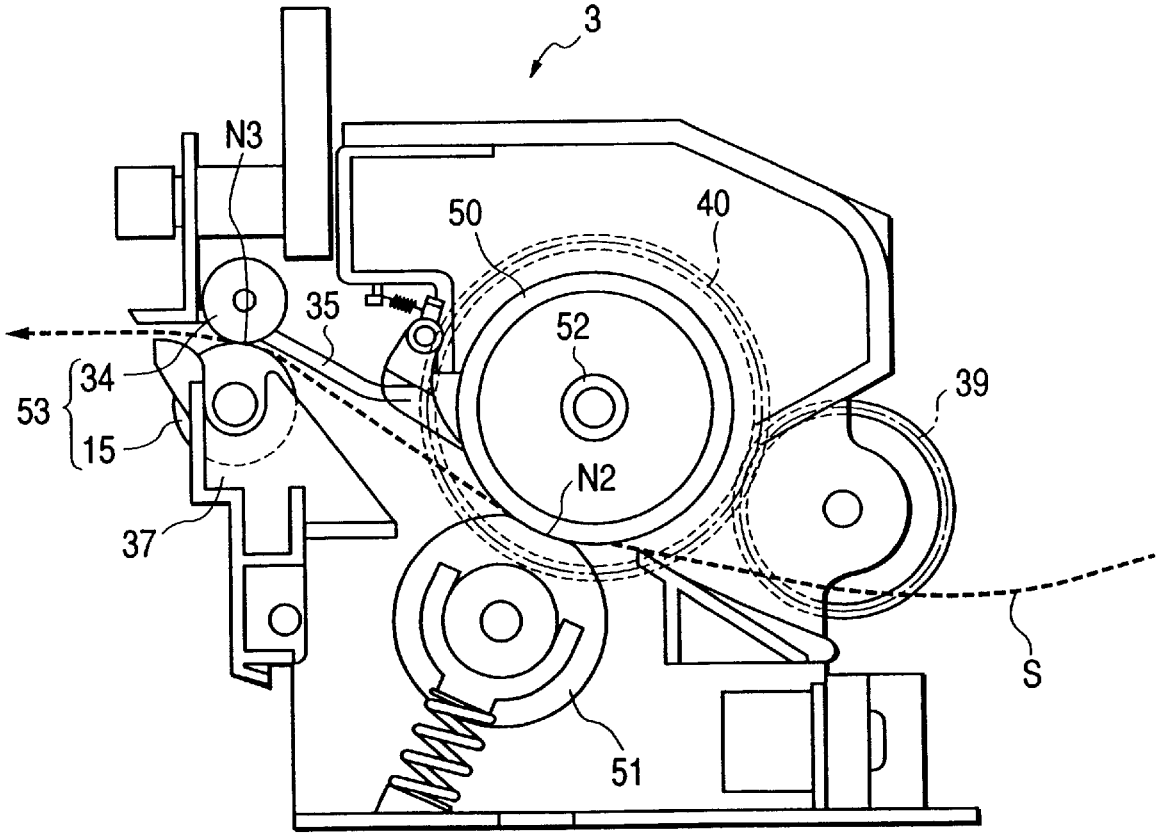
FIG. 2 is a schematic sectional view showing an outline of the configuration of the fixing apparatus shown in FIG. 1.

FIG. 2 is a schematic sectional view showing an outline of a configuration of the fixing apparatus 3, which includes of a cylindrical rotatable fixing roller 50 adopted as the fixing rotary body, a cylindrical rotatable press roller 51 adopted as the press rotary body, a halogen heater 52 adopted as the heating body, a plurality of sheet discharge rotating body pairs 53 and so on: each sheet discharge rotary body pair 53 including a cylindrical rotatable pinch roller 34 as an upper rotary body and a cylindrical rotatable conveying roller 15 as a lower rotary body.

In the first embodiment, a driving power is transmitted and supplied from a driving power source (not shown) disposed outside the printer body 1 through gears 39 and 40 to the fixing roller 50, whereby it rotates clockwise and the press roller 51 rotates following the rotation of the fixing roller 50.

In the fixing apparatus 3, the fixing treatment of the sheet S which bears the non-fixed image is performed by heating the sheet S with the halogen heater 52 while passing the sheet S between the fixing roller 50 and the press roller 51, and the sheet S which has been subjected to the fixing treatment is nipped and conveyed by pairs of the conveying rotary bodies 53 for discharge out of the fixing apparatus main body 3.

Figure 3:
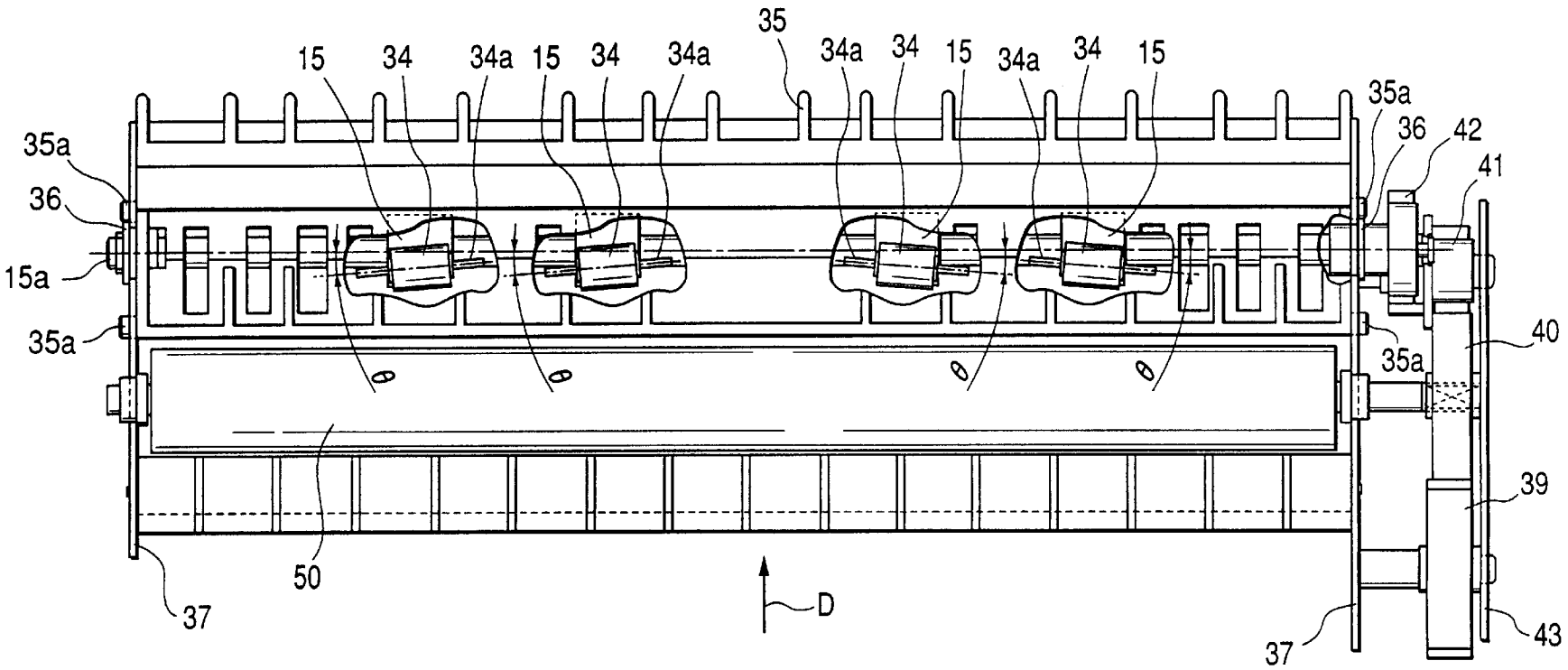
FIG. 3 is a schematic explanatory view showing a sheet discharge section of the fixing apparatus shown in FIG. 1 as seen from a side of a non-fixed image bearing surface.

FIG. 3 is a schematic explanatory view showing the sheet discharge section of the fixing apparatus 3 as seen from the side of the surface bearing non-fixed image of the sheet, wherein the pinch rollers 34 are rotatably supported by an upper sheet discharge guide 35 which composes a portion of the fixing apparatus body, whereas the conveying rollers 15 are rotatably supported since the shaft body 15*a* of the conveying rollers 15 is supported by bearings 36 which are pressed into a lower sheet discharge guide 37 which also composes a portion of the fixing apparatus body 3.

The upper sheet discharge guide 35 is attached to the lower sheet discharge guide 37 by fitting bosses 35*a* formed at both ends in a longitudinal direction of the upper sheet discharge guide 35 into holes (not shown) formed in the lower sheet discharge guide 37.

The each pinch rollers 34 are arranged symmetrically or nearly symmetrically with regard to a center in the longitudinal direction of the upper sheet discharge guide 35 and a rotating axis of each pinch roller 34 is disposed along a direction which is on a plane in parallel with the sheet S and inclined at a predetermined angle of θ relative to a rotating axis of the fixing roller 50.

The first embodiment is configured to prevent a semi-melted developer on the sheet S from adhering to a surface of the pinch roller since the pinch roller 34 is brought into slide contact with the sheet S which is travelling in a direction indicated by an arrow D while the pinch roller 34 is rotating around the axis which is on the plane in parallel with the sheet S and inclined at the predetermined angle θ relative to the rotating axis of the fixing roller 50.

It is needless to say that each pinch roller 34 is configured to prevent a skew-feed of the sheet S since a travelling direction of the sheet S is usually governed by a rotating direction of the press roller 51 in the fixing apparatus body 3.

Furthermore, the first embodiment is configured to prevent the sheet S from being wrinkled since the pinch rollers 34 are arranged symmetrically or nearly symmetrically with regard to the center in the longitudinal direction of the upper sheet discharge guide 35 so that the rotation of the pinch rollers 34 stretch the sheet S toward both sides, which sheet S is travelling in the direction indicated by the arrow D.

On the other hand, each conveying roller 15 is configured to be rotated with a driving power which is transmitted and supplied through gears 39, 40, 41 and 42 from the driving power supply source (not shown) disposed in the printer main body, whereby each pinch roller rotates following the rotation of the conveying roller 15.

Furthermore, the gears 39, 40, 41 and 42 are in mesh with in this order, and a metal plate 43 is disposed as a stopper for the gears in the first embodiment.

In the first embodiment, a circumferential speed of each conveying roller 15 is set at a level higher than those of the fixing roller 50 and the press roller 51 to prevent the sheet S from undulating in a section from a fixing nip N2 formed between the fixing roller 50 and the press roller 51 to a sheet discharging nip N3 formed between each pair of the paper discharge rotary bodies 53.

Now, a manner which is adopted in the first embodiment for supporting the pinch roller 34 on the upper sheet discharge guide 35 will be described with reference to FIGS. 4 and 5.

Figure 4:
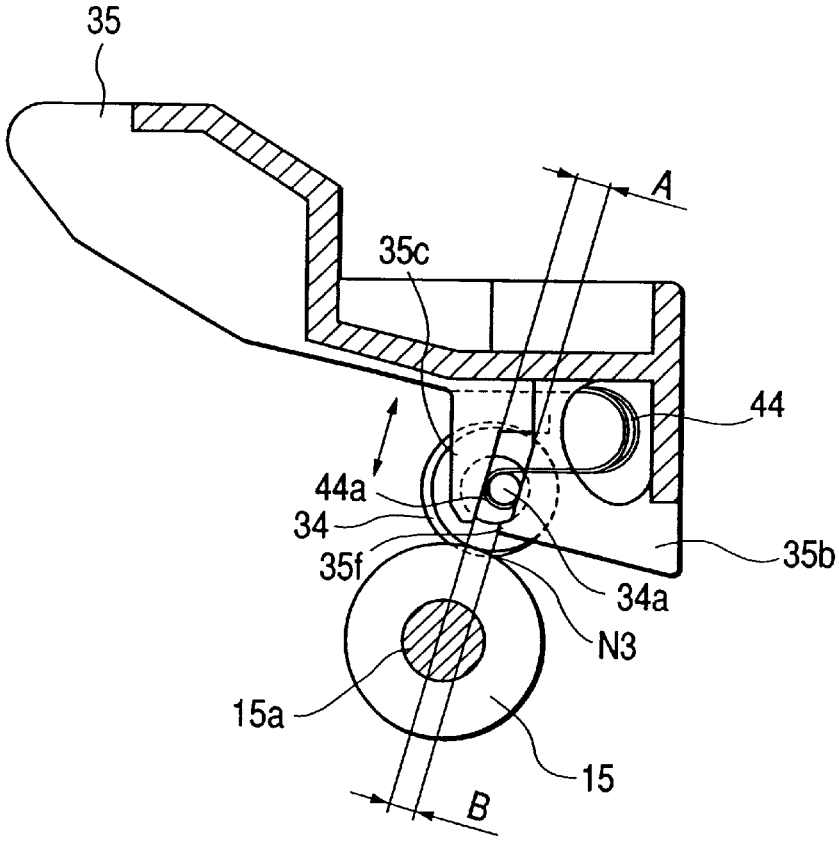
FIG. 4 is a schematic explanatory view showing the sheet discharge section of the fixing apparatus shown in FIG. 1 as seen from a side of side surface of a pinch roller.
Figure 5:
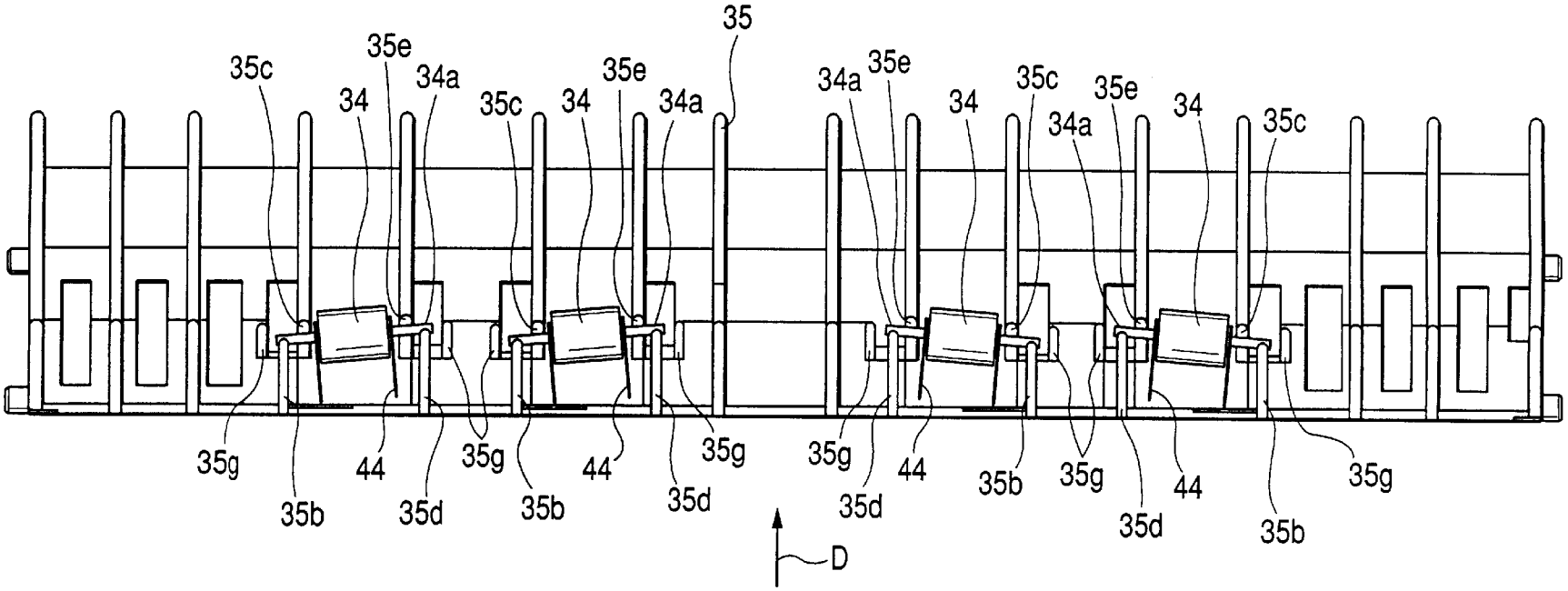
FIG. 5 is a schematic explanatory view showing the sheet discharge section of the fixing apparatus shown in FIG. 1 as seen from a side of a conveying roller.

FIG. 4 is a schematic explanatory view showing the sheet discharge section of the fixing apparatus 3 as seen from aside surface of the pinch roller 34 and FIG. 5 is a schematic explanatory view showing the sheet discharge section of the fixing apparatus 3 as seen from a side of the conveying roller 15.

An end of the shaft body 34*a* attached to each pinch roller 34 is sandwiched between a rib 35*b* and a rib 35*c* of the sheet discharge guide 35 as shown in FIGS. 4 and 5, whereas another end of the shaft body 34*a* is sandwiched between a rib 35*d* and a rib 35*e* of the sheet discharge guide 35 so that each pinch roller 34 is rotatable and movable in the direction indicated by the arrow D.

Furthermore, a winding portion 44*a* which is an end of an elastic spring 44 is wound around both ends of the shaft body 34*a* as shown in FIG. 4 so that both the ends of the shaft body 34*a* are urged by the elastic spring 44, thereby bringing the pinch roller 34 into pressure contact with the conveying roller 15 to compose the pair of sheet discharge rotary bodies 53.

In the first embodiment, a winding diameter of the winding portion 44*a* is set at a value larger than an outside diameter of the shaft body 34*a* of the pinch roller 34 so that the winding portion 44*a* will not hinder the rotation of the pinch roller 34.

In the first embodiment, an interval A is set at a value larger than the outside diameter of the shaft body 34*a* and an interval B is set at a values slightly smaller than the outside diameter of the shaft body 34*a* in a gap between the rib 35*b* and the rib 35*c* which is reserved for supporting the end of the shaft body of the pinch roller 34 as shown in FIG. 4 to prevent the pinch roller 34 from being urged by the elastic spring 44 and detached from the upper sheet discharge guide 35 when the upper sheet discharge guide 35 is detached from the lower sheet discharge guide 37.

Furthermore, ribs 35*g* are disposed on the upper sheet discharge guide 35 to restrict the pinch rollers 34 in a thrust direction in the first embodiment.

Since the pinch rollers 34 whose rotating axial directions are set in the directions which are on the plane in parallel with the surface of the sheet S and inclined at the predetermined angle θ relative to the rotating axes of the fixing roller 50 and the press roller 51 apply rotating forces in directions perpendicular to the rotating axial directions inclined at the angle θ to the sheet S which has been subjected to the fixing treatment while it is passing through the fixing nip N2, the sheet S which has been subjected to the fixing treatment is brought into slide contact with the pinch rollers 34 while passing through the sheet discharge nips N3, the first embodiment is capable of facilitating to prevent the semi-melted developer from adhering from the sheet S which has been subjected to the fixing treatment to the surfaces of the pinch rollers 34, thereby securely preventing the semi-melted developer from growing into lumps adhering to the surface on the pinch rollers.

In order words, since the sheet S passes while sliding on the surfaces of the pinch rollers 34, the semi-melted developer on the sheet S can adhere to the pinch rollers 34 more hardly than a case where the sheet S does not slide on the pinch rollers 34 but rotates the pinch rollers 34 following after the sheet S.

Even if the semi-melted developer adheres to the surfaces of the pinch rollers 34, the adhesion of the semi-melted developer is scarcely remarkable since the semi-melted developer is transferred again to the sheet S while being dispersed on the surfaces of the pinch rollers 34 due to the slide contact with the sheet S.

Furthermore, the first embodiment provides a merit to prevent the sheet S from undulating in the section from the fixing nip N2 to the sheet discharge nips N3 since the sheet S which enters each sheet discharge nip N3 is nipped and conveyed by the sheet discharge rotary body pairs 53 at a speed higher than the sheet conveying speed through the fixing nip N2.

Furthermore, since conveying forces which are symmetrical or nearly symmetrical with regard to the center in the rotating axial directions of the fixing roller 50 and the press roller 51 are applied to the sheet which has been subjected to the fixing treatment which passing through each sheet discharge nip N3, the sheet S is tensed toward both the sides by the conveying forces applied from the pinch rollers 34 while passing through each sheet discharge nip N3, whereby the first embodiment provides a merit to prevent the sheet S from being wrinkled during passage through each sheet discharge nip.

Moreover, it is needless to say that the effects and merits of the first embodiment can be enhanced by selecting fluoroplastic materials mainly such as PFA as surface materials for the pinch rollers 34.

In addition, it is needless to say that effects and merits of the first embodiment can similarly be obtained by adopting the first embodiment to image forming apparatus using developers prepared to have lower melting points.

(Second Embodiment)

Now, a second embodiment of the present invention will be described with reference to FIGS. 6, 7A and 7B.

Since an image forming apparatus preferred as the second embodiment has a configuration which is schematically the same as that of the first embodiment described above, reference can be made to FIG. 1 in place of description of the configuration of the second embodiment.

Figure 6:
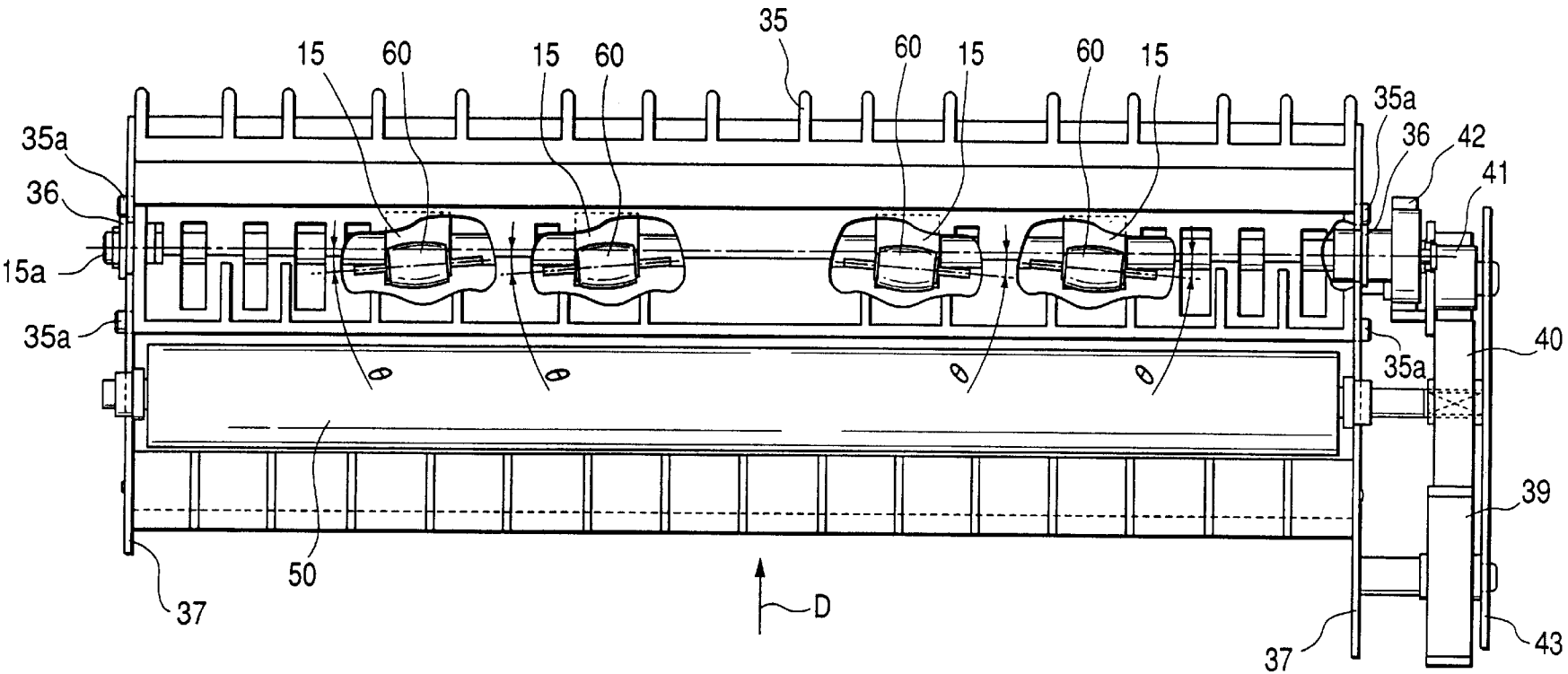
FIG. 6 is a schematic explanatory view showing a sheet discharge section in a second embodiment of the fixing apparatus according to the present application as seen from a side of a sheet bearing surface.

FIG. 6 is a schematic explanatory view showing a sheet discharge section of a fixing apparatus preferred as the second embodiment as seen from aside of a sheet bearing surface.

In the second embodiment, adopted as an upper rotary body is a barrel-shaped rotatable pinch roller 60 having a diameter in the middle which is larger than that at both ends and outer circumferential surfaces which are shaped smooth at both ends in a rotating axial direction of the pinch roller 60 as shown in FIG. 6.

Figure 7A:
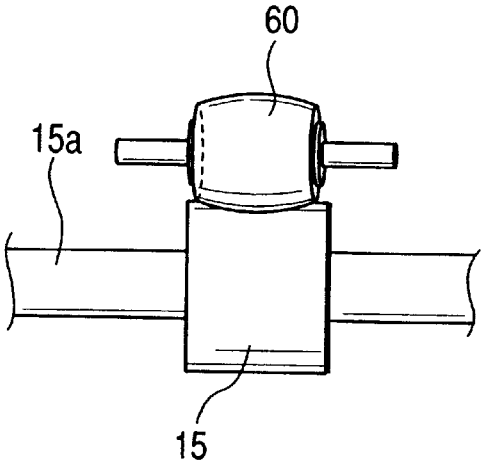
FIGS. 7A and 7B are schematic explanatory views of a pair of sheet discharge rotary bodies in the second embodiment of the present application: Particularly FIG. 7A being a view showing a case wherein two planes including rotating axial directions of a pinch roller and a conveying roller are in parallel with each other, whereas FIG. 7B being a view showing a case wherein the two planes are not in parallel with each other.
Figure 7B:
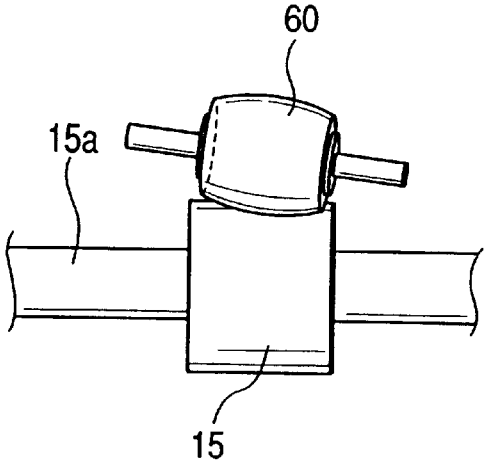

The second embodiment is configured to be capable of preferably conveying a sheet not only in a case where two planes including rotating axial directions of the pinch roller 60 and a conveying roller 15 are in parallel with each other as shown in FIG. 7A but also in another case where the two planes are not in parallel with each other as shown in FIG. 7B.

FIGS. 7A and 7B are schematic explanatory views of a pair of sheet discharge rotary bodies adopted for the second embodiment: Particularly FIG. 7A being a view showing the case where the two planes including the rotating axial directions of the pinch roller 60 and the conveying roller 15 are in parallel with each other, whereas FIG. 7B being a view showing the case where the two planes are not in parallel with each other.

Since the outer circumferential surfaces at both ends in the rotating axial direction of the pinch roller 60 are shaped smooth, the second embodiment is configured to prevent stripes from being formed on the sheet S due to slide contact between both ends in the rotating axial direction of the pinch roller 60 and the sheet S even when the two planes including the rotating axial directions of the pinch roller 60 and the conveying roller 15 are not in parallel with each other as shown in FIG. 7B.

Accordingly, the second embodiment provides not only effects and merits which are similar to those of the first embodiment but also another merit to securely prevent stripes from being formed due to slide contact between both the ends in the rotating axial directions of the pinch roller 60 and the sheet S even when the two planes including the rotating axial directions of the pinch roller 60 and the conveying roller 15 are not in parallel with each other.

(Third Embodiment)

Now, description will be made of a third embodiment of the present invention with reference to FIGS. 8A to 8C and FIG. 9.

Since an image forming apparatus preferred as the third embodiment has a configuration which is schematically similar to that of image forming apparatus preferred as the first embodiment, reference is to be made to FIG. 1 for the configuration of the third embodiment.

Figure 8A:
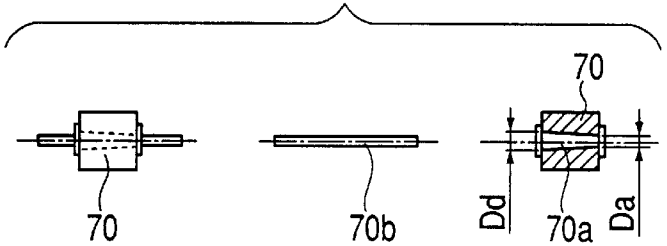
FIGS. 8A, 8B and 8C are schematic explanatory views of a sheet discharge section in a third embodiment of the fixing apparatus according to the present application: Particularly FIG. 8A being a view schematically showing a form of a pinch roller, FIG. 8B being an explanatory view of insertion of a shaft body into a through bore of the pinch roller and FIG. 8C being a view showing the pinch roller in a rotating condition.
Figure 8B:
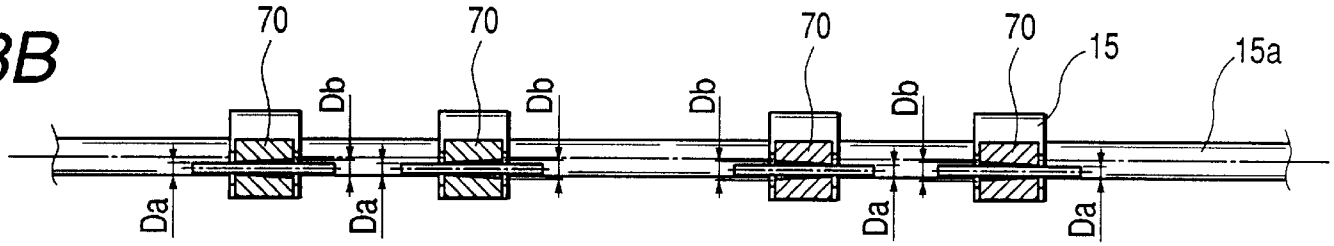
Figure 8C:
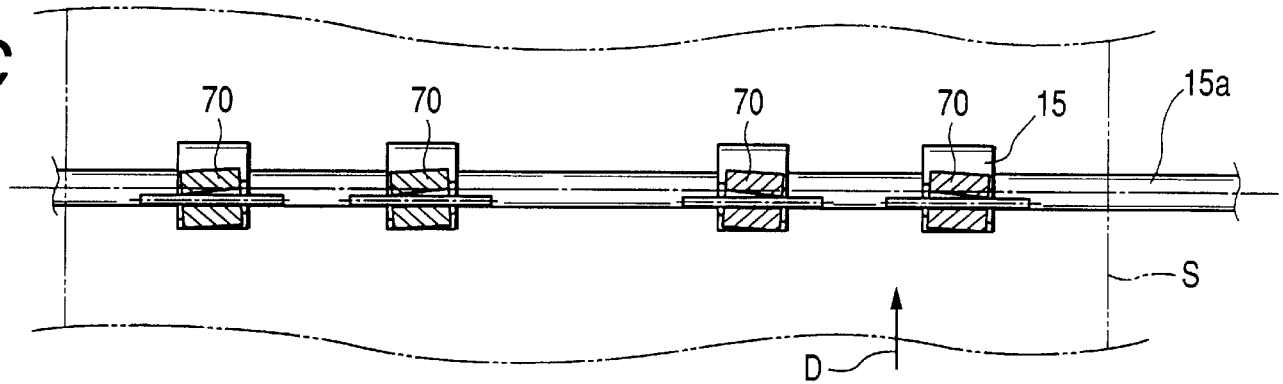

FIGS. 8A to 8C are schematic explanatory views of a sheet discharge section of a fixing apparatus in the third embodiment: Particularly FIG. 8A being a view schematically showing a form of a pinch roller 70 adopted as an upper rotary body in the third embodiment, FIG. 8B being an explanatory view of insertion of a shaft body 70*b* through a through bore 70*a* of the pinch roller 70 and FIG. 8C being a view showing the pinch roller 70 in its rotating condition.

In the third embodiment, formed in the rotatable cylindrical pinch roller 70 is the through bore 70*a* which has an inside diameter continuously enlarged from one end to the other end in a rotating axial direction of the pinch roller 70 as shown in FIG. 8A, inserted into the through bore 70*a* is the cylindrical shaft body 70*b* which rotatably supports the pinch roller 70 as shown in FIG. 8B and the shaft body 70*b* has an outside diameter which is not larger than a small diameter of the through bore 70*a* as shown in FIG. 8A.

In the third embodiment, an inside diameter Da of the through bore 70*a* at ends on the paper surface of the drawing is smaller than an inside diameter Db of the through bore 70*a* in the middle on the paper surface of the drawing and, from the end on the paper surface toward the middle on the paper surface, an inside diameter of a section of the through bore 70*a* from the end on the paper surface to the middle on the paper surface is continuously enlarged from the inside diameter value of Da to the inside diameter value of Db.

Figure 9:
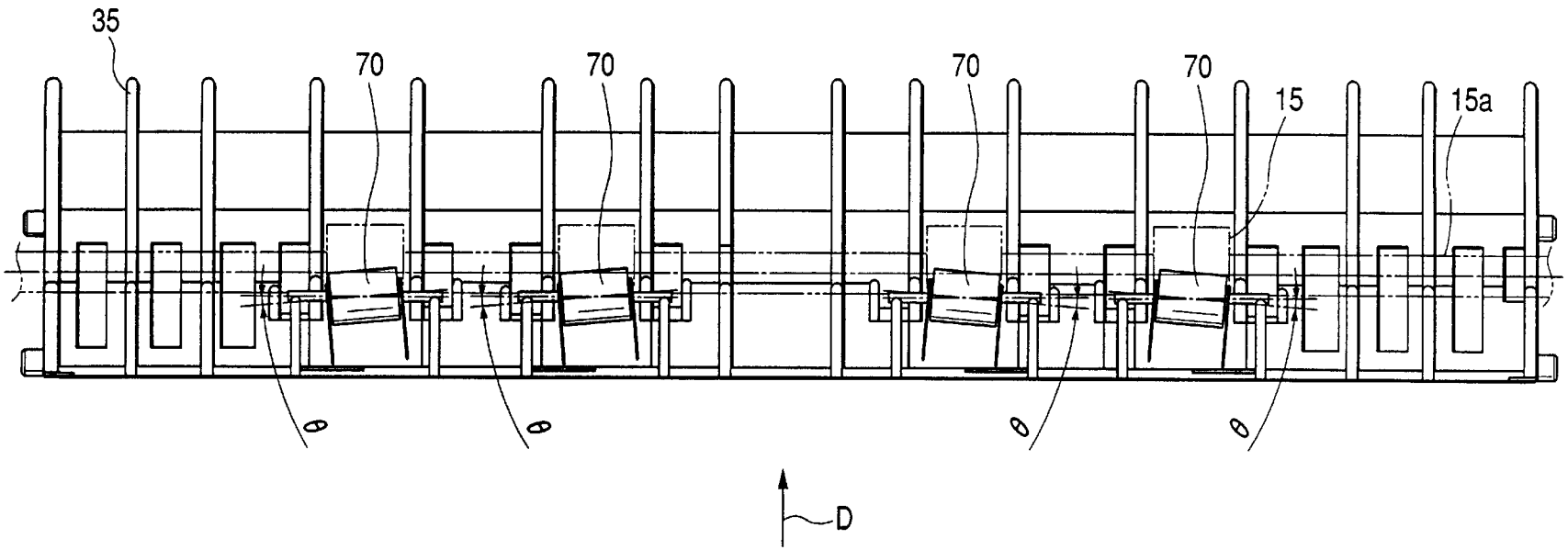
FIG. 9 is a schematic explanatory view showing the sheet discharge section in the third embodiment of the fixing apparatus according to the present application as seen from a side of a non-fixed image bearing surface.

Since the through bore 70*a* of the pinch roller 70 has the inside diameter Db which is larger than the outside diameter of the shaft body 70*b* at the other end of the pinch roller 70 as shown in FIG. 8A in the third embodiment, a gap is formed in the through bore 70*a* at the other end as shown in FIG. 8C, whereby the pinch roller 70 rotates in a direction which is included in a plane in parallel with the sheet S and inclined at a predetermined angle θ relative to the rotating axial directions of the fixing roller 50 and the press roller 51, that is, the longitudinal direction of the upper sheet discharge guide 35 as shown in FIG. 9.

FIG. 9 is a schematic explanatory view showing the sheet discharge section of the fixing apparatus preferred as the third embodiment as seen from the side of the non-fixed image bearing surface.

Accordingly, the third embodiment is also capable of providing effects and merits which are similar to those of the first embodiment.

Needless to say, the third embodiment allows, like the first embodiment, its effect and merits to be enhanced by composing surfaces of the pinch rollers 70 mainly of a fluoroplastic material such as PFA.

Needless to say, the third embodiment is capable, like the first embodiment, of exhibiting its effects and merits also when it is adopted for an image forming apparatus which uses a developer having a low melting point.

(Fourth Embodiment)

Now, a fourth embodiment of the present invention will be described with reference to FIGS. 10A to 10C.

Since an image forming apparatus preferred as the fourth embodiment has a configuration which is schematically the same as that of the first embodiment, reference is to be made to FIG. 1 for the configuration of the fourth embodiment.

Figure 10A:
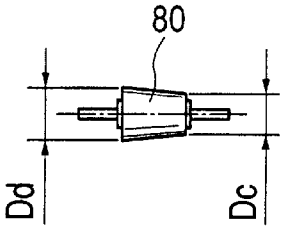
FIGS. 10A, 10B and 10C are schematic explanatory views of a sheet discharge section in a fourth embodiment of the fixing apparatus according to the present application: Particularly FIG. 10A being a view schematically showing a form of a pinch roller, FIG. 10B being a view showing the pinch roller and a conveying roller which are in pressure contact with each other and FIG. 10C being a view showing the pinch roller in its rotating condition.
Figure 10B:
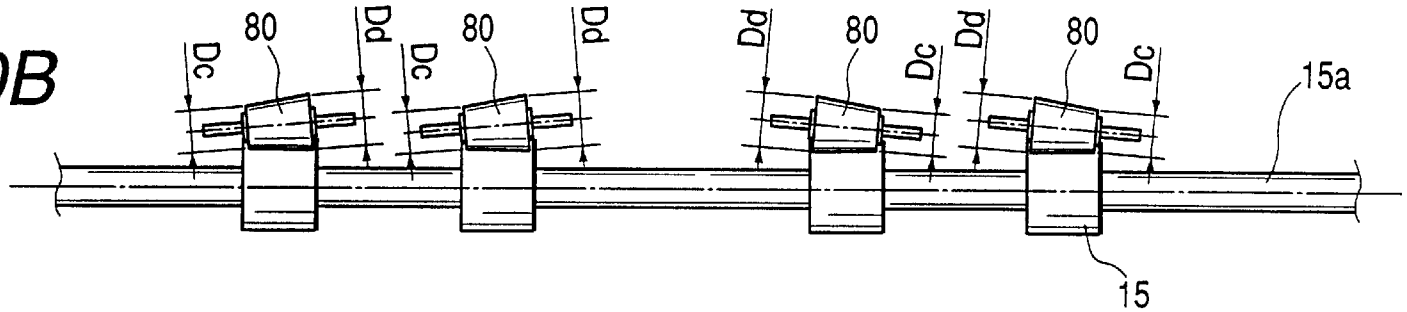
Figure 10C:
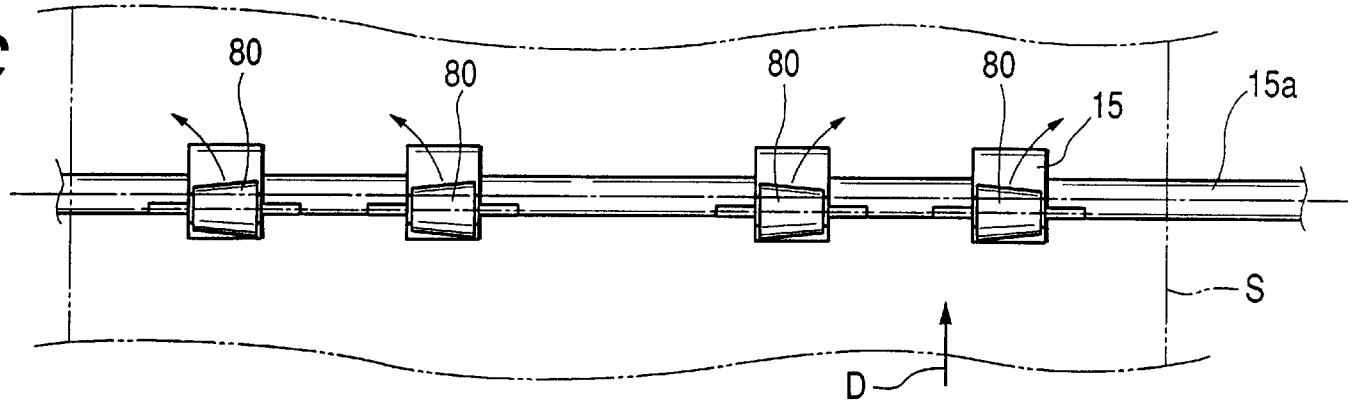
Figure 11:
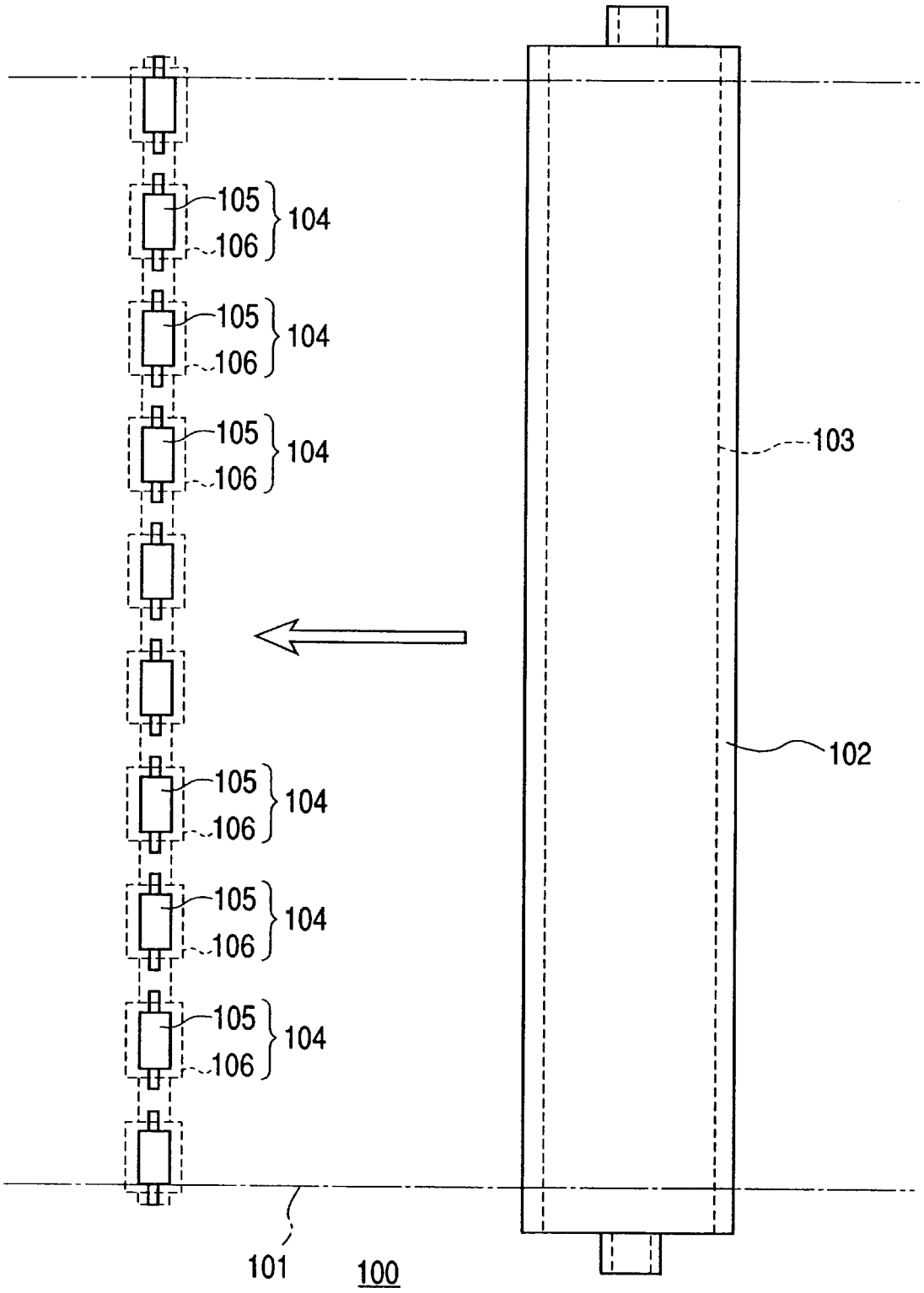
FIG. 11 is a schematic front view showing an outline of a configuration of a conventional fixing apparatus.

FIGS. 10A to 10C are schematic explanatory views of a sheet discharge section of a fixing apparatus of the fourth embodiment: Particularly FIG. 10A being a view schematically showing a form of a pinch roller 80 used as an upper rotary body in the fourth embodiment, FIG. 10B being a view showing the pinch roller 80 and a conveying roller 15 which are in a condition of press contact with each other and FIG. 10C being a view showing the pinch roller 80 in its rotating condition.

In the fourth embodiment adopts as the upper rotary body, the pinch roller 80 which is formed so as to have an outside diameter continuously enlarged from one end toward the other end in a rotating axial direction as shown in FIG. 10A.

In the fourth embodiment wherein an outside diameter Dc of the pinch roller 80 at ends on the paper surface of the drawing is smaller than an outside diameter Dd in the middle on the paper surface of the drawing as shown in FIG. 10B, the pinch roller 80 rotates in a direction which is included in a plane in parallel with the sheet S and inclined at a predetermined angle θ relative to the rotating axial directions of the fixing roller 50 and the press roller 51, that is, the longitudinal direction of the sheet discharge guide 35.

Accordingly, the fourth embodiment provides effects and merits which are similar to those of the first embodiment.

Needless to say, the fourth embodiment allows, like the first embodiment, its effects and merits to be enhanced by composing surfaces of the pinch rollers mainly of a fluoroplastic material such as PFA.

Needless to say, the fourth embodiment is capable, like the first embodiment, of exhibiting its effects and merits also when it is adopted for an image forming apparatus which uses a developer having a low melting point.

Though each of the first to fourth embodiments have been described above as the fixing apparatus equipped with the fixing roller and the halogen heater, i.e., the so-called roller type fixing apparatus, it is needless to say that the similar effects and merits can be obtained by applying each of the first to fourth embodiment as a fixing apparatus including an endless belt shaped film used as a fixing body and a ceramic heater provided with a substrate made mainly of a ceramic material, a heating member which receives an electric power from an electric power source to generate heat and is disposed on a surface of the substrate, and a temperature detecting member disposed in contact with or in the vicinity of another surface of the substrate, i.e., the so-called film type fixing apparatus.

In the film type fixing apparatus, a sheet is nipped and conveyed by the rotating endless belt shaped film and a press roller, the heating member is disposed on an inner circumferential surface of the endless belt shaped film and the sheet which is conveyed on an outer circumferential surface of the film is heated by the heating member through the film.

Figure 12:
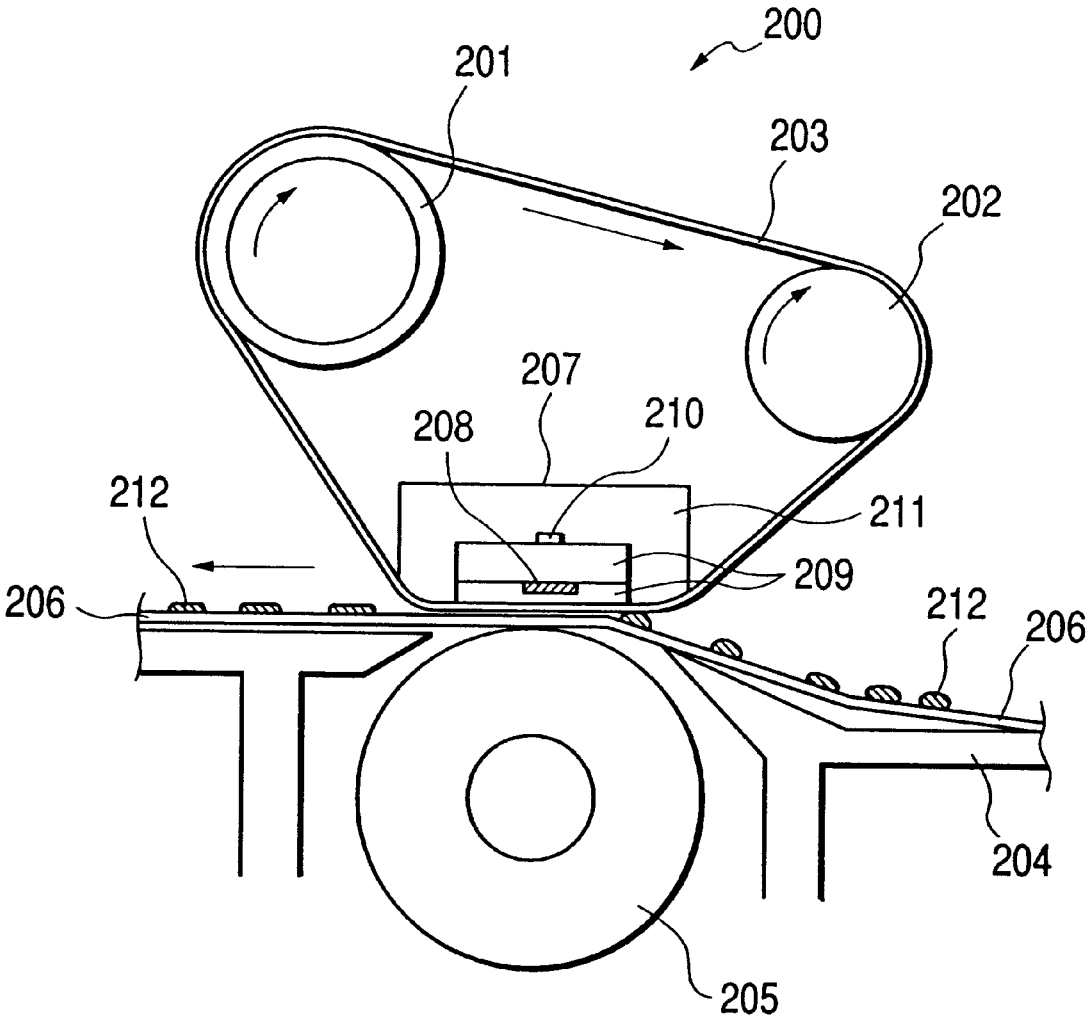
FIG. 12 is an explanatory view of a fixing apparatus which uses an endless belt of film.

FIG. 12 is an explanatory view of a fixing apparatus 200 which uses an endless belt shaped film.

The film heating type fixing apparatus 200 includes, as shown in FIG. 12, a fixing film 203 which is driven in a direction by driving rollers 201 and 202, and a heating body 207 which heats and fixes a sheet 206 guided by a guide 204 and conveyed between the fixing film 203 and a press roller 205. The heating body 207 includes a heat generating body 208, a heater substrate 209 which sandwiches the heat generating body 208, a temperature detecting element 210 which detects a temperature of the heat generating body 208 through the heater substrate 208 and a heater support body 211 which supports all the members mentioned above.

On performing an image fixation, the fixing apparatus 200 configured as described above moves the fixing film 203 with the driving rollers 201 and 202 in a normal direction and at the same speed as the sheet 206 which is conveyed and introduced between the fixing film 203 and the press roller 205 for image fixing. By passing the sheet 206 through a fixing nip which is formed as a fixing section by press contact between the heating body 207 and the press roller 205 with the travelling fixing film 203 interposed, the fixing apparatus softens and melts a visible image 212 (non-fixed toner image) on the sheet 206 by imparting a heat energy to it, and then separates the sheet from the film at a separating point after passing through the fixing section.

Incidentally, the heating body may use an electromagnetic induction unit for heating the film without using the heat generating body.

Though each of the first to fourth embodiments has been described above as it is used with a laser printer which is an example of image forming apparatus, similar effects and merits can be obtained even when it is applied to a facsimile, a copying machine or the like which is another example of image forming apparatus.

As understood from the foregoing description, the first invention according to the present application is configured so that a recording medium which has been subjected to a fixing treatment and is passing between pairs of sheet discharge rotary bodies receives at least from upper rotary bodies conveying forces in directions which are on a plane in parallel with a surface of the recording medium and inclined relative to a recording medium conveying direction between a fixing rotary body and a press rotary body, and the recording medium which has been subjected to the fixing treatment is brought into slide contact with the upper rotary bodies while passing between the sheet discharge rotary bodies, whereby the first invention makes it possible to facilitate to prevent a semi-melted developer from adhering from the recording medium which has been subjected to the fixing treatment to surfaces of the upper rotary bodies and securely preventing the semi-melted developer adhering to the upper rotary bodies from growing into lumps of the developer.

Furthermore, the second invention according to the present application is configured to nip a recording medium which enters between the sheet discharge rotary bodies with the pairs of the sheet discharge rotary bodies and convey the recording medium at a speed higher than a recording medium conveying speed between the fixing rotary body and the press rotary body, whereby the second invention makes it possible to prevent the recording medium from undulating in a section from a fixing nip formed between the fixing rotary body and the press rotary body to sheet discharge nips formed between the sheet discharge rotary bodies.

Furthermore, the third invention according to the present application is configured so that the upper rotary bodies which have rotating axial directions set in directions which are on a plane in parallel with a surface of the recording medium and inclined relative to rotating axial directions of the fixing rotary body and the press rotary body apply conveying forces in directions perpendicular to the rotating axial directions of the upper rotary bodies to the recording medium which has been subjected to the fixing while the recording medium is passing between the pairs of the sheet discharge rotary bodies, and the recording medium which has been subjected to the fixing treatment is brought into slide contact with the upper rotary bodies while passing between the pairs of upper rotary bodies, whereby the third invention makes it possible to facilitate to prevent the semi-melted developer from adhering from the recording medium which has been subjected to the fixing treatment to the surfaces of the upper rotary bodies and securely prevent the semi-melted developer adhering to the surfaces of the upper rotary bodies from growing into lumps of the developer.

Furthermore, the fourth invention according to the present application is configured so that the upper rotary bodies each having a through bore which has an inside diameter continuously enlarged from one end to the other end in a rotating axial direction, and into which through bore a shaft body having an outside diameter which is smaller than a small diameter of the through bore is inserted apply conveying forces in directions inclined toward the one end, and the recording medium which has been subjected to the fixing treatment is brought into slide contact with the upper rotary bodies while passing between the pairs of upper rotary bodies, whereby the fourth invention makes it possible to facilitate to prevent the semi-melted developer from adhering from the recording medium which has been subjected to the fixing treatment to the surfaces of the upper rotary bodies and securely prevent the semi-melted developer adhering to the surfaces of the upper rotary bodies from growing into lumps of the developer.

Furthermore, the fifth invention according to the present application is configured so that the upper rotary bodies each configured to have an outside diameter which is enlarged from one end to the other end in a rotating axial direction apply conveying forces in directions inclined toward the one end to the recording medium which has been subjected to the fixing treatment while passing between the pairs of sheet discharge rotary bodies, and the recording medium which has been subjected to the fixing treatment is brought into slide contact with the upper rotary bodies while passing between the pairs of sheet discharge rotary bodies, whereby the fifth invention makes it possible to facilitate to prevent the semi-melted developer from adhering from the recording medium which has been subjected to the fixing treatment to the surfaces of the upper rotary bodies and securely prevent the semi-melted developer adhering to the surfaces of the upper rotary bodies from growing into lumps of the developer.

Furthermore, the sixth invention according to the present application is configured so that the upper rotary bodies apply conveying forces which are symmetrical or nearly symmetrical with regard to the center in the rotating axial directions of the fixing rotary body and the press rotary body to the recording medium which has been subjected to the fixing treatment while passing between the plurality of pairs of sheet discharge rotary bodies, and the recording medium which has been subjected to the fixing treatment is tensed toward both sides by the conveying forces from the upper rotary bodies while passing between the pairs of sheet discharge rotary bodies, whereby the sixth embodiment makes it possible to prevent the recording medium from being wrinkled while passing between the pairs of sheet discharge rotary bodies.

Furthermore, the seventh invention according to the present application is configured so that the upper rotary bodies each being shaped so as to have smooth outer circumferential surfaces at both ends in the rotating axial direction are brought into slide contact with the recording medium which has been subjected to the fixing treatment while passing between the pairs of sheet discharge rotary bodies, whereby the seventh invention is makes it possible to prevent stripes from being formed due to slide contact between both the ends of the upper rotary body and the recording medium which has been subjected to the fixing treatment while passing between the pairs of sheet discharge rotary bodies.

Furthermore, the eighth invention according to the present application is configured to bring upper rotary bodies having surfaces made mainly of a fluoroplastic material into slide contact with the recording medium which has been subjected to the fixing treatment while passing between the pairs of sheet discharge rotary bodies, whereby the eighth embodiment makes it possible to enhance the function to prevent the semi-melted developer on the recording medium which has been subjected to the fixing treatment from adhering to the surfaces of the upper rotary bodies.

Furthermore, the ninth invention according to the present application is configured so that the recording medium which bears a non-fixed image is subjected to the fixing treatment by heating with the ceramic heater while the recording medium is passing between the heat resistant film and the press rotary body, and nipped, conveyed and discharged out of the fixing apparatus main body with the pairs of sheet discharge rotary bodies, whereby the ninth invention makes it possible to provide a fixing apparatus which exhibits the effects of the first to eighth inventions and is configured to speedily heat a fixing nip formed between the film and the press rotary body.

Furthermore, the tenth invention according to the present application is configured so that the conveying forces are applied in directions which are in parallel with a surface of the recording medium which has been subjected to the fixing treatment and inclined relative to the recording medium conveying direction between the fixing rotary body and the press rotary body from at least the upper rotary bodies to the recording medium while passing between the pairs of sheet discharge rotary bodies, and the upper rotary bodies are brought into slide contact with the recording medium while passing between the pairs of sheet discharge rotary bodies, whereby the tenth invention makes it possible to provide an image forming apparatus equipped with a fixing apparatus which is capable of facilitating to prevent a semi-melted developer from adhering from a recording medium which has been subjected to a fixing treatment to surfaces of upper rotary bodies and securely prevent the semi-melted developer adhering to the surfaces from growing into lumps of the developer.

Furthermore, the eleventh invention according to the present application is configured so that the recording medium which has entered between the pairs of sheet discharge rotary bodies is nipped and conveyed by the pairs of paper discharge rotary bodies at a speed higher than the recording medium conveying speed between the fixing rotary body and the press rotary body, whereby the eleventh invention makes it possible to provide an image forming apparatus equipped with a fixing apparatus which is capable of preventing the recording medium from being undulating in a section from a fixing nip formed between the fixing rotary body and the press rotary body to a sheet discharge nip formed between the pairs of sheet discharge rotary bodies.

Furthermore, the twelfth invention according to the present application is configured so that the upper rotary bodies having rotating axial directions set in the directions which are on the plane in parallel with the surface of the recording medium which has been subjected to the fixing treatment and inclined relative to the directions of rotating axial directions of the fixing rotary body and the press rotary body apply conveying forces in directions perpendicular to the rotating axial directions of the upper rotary bodies to the recording medium which has been subjected to the fixing treatment, and the upper rotary bodies are brought into slide contact with the recording medium while passing between the pairs of sheet discharge rotary bodies, whereby the twelfth invention makes it possible to provide the image forming apparatus equipped with the fixing apparatus which is capable of facilitating to prevent the semi-melted developer from adhering from the recording medium which has been subjected to the fixing treatment to the surfaces of the upper rotary bodies, thereby securely preventing the semi-melted developer from adhering to the surfaces of the upper rotary bodies and growing into lumps of the developer.

Furthermore, the thirteenth invention according to the present application is configured so that the upper rotary bodies each having a through bore which has an inside diameter continuously enlarged from one end to the other end in a rotating axial direction and into which a shaft body having an outside diameter smaller than a small diameter of the through bore is inserted apply conveying forces in directions inclined toward the one end to the recording medium which has been subjected to the fixing treatment while passing between the pair of sheet discharge rotary bodies, and the upper rotary bodies are brought into slide contact with the recording medium which has been subjected to the fixing treatment while passing between the pairs of sheet discharge rotary bodies, whereby the thirteenth invention makes it possible to provide the image forming apparatus equipped with the fixing apparatus which is capable of facilitating to prevent the semi-melted developer from adhering from the recording medium which has been subjected to the fixing treatment to the surfaces of the upper rotary bodies, thereby securely preventing the semi-melted developer from adhering to the surfaces of the upper rotary bodies and growing into lumps of the developer.

Furthermore, the fourteenth invention according to the present application is configured so that the upper rotary bodies each having the outside diameter continuously enlarged from one end to the other end in a rotating axial direction apply conveying forces in directions inclined toward the one direction to the recording medium which has been subjected to the fixing treatment while passing between the pairs of sheet discharge rotary bodies, and the upper rotary bodies are brought into slide contact with the recording medium which has been subjected to the fixing treatment while passing between the pairs of sheet discharge rotary bodies, whereby the fourteenth invention makes it possible to provide an image forming apparatus equipped with the fixing apparatus which is capable of facilitating to prevent the semi-melted developer from the recording medium which has been subjected to the fixing treatment to the surfaces of the upper rotary bodies, thereby securely preventing the semi-melted developer from adhering to the surfaces of the upper rotary bodies and growing into lumps of the developer.

Furthermore, the fifteenth invention according to the present application is configured so that the conveying forces symmetrical or nearly symmetrical with regard to the center in the rotating axial directions of the fixing rotary body and the press rotary body are applied from the upper rotary bodies to the recording medium which has been subjected to the fixing treatment while passing between the plurality of pairs of sheet discharge rotary bodies and the recording medium is tensed toward both the sides thereof by the conveying forces from the upper rotary bodies while it is passing between the pairs of sheet discharge rotary bodies, whereby the fifteenth invention makes it possible to provide an image forming apparatus equipped with the fixing apparatus which is configured to prevent the recording medium from being wrinkled while the recording medium passes between the pairs of sheet discharge rotary bodies.

Furthermore, the sixteenth invention according to the present application is configured so that the upper rotary bodies having outer circumferential surfaces at both the ends in the rotating axial direction are brought into slide contact with the recording medium which has been subjected to the fixing treatment while passing between the pairs of sheet discharge rotary bodies, whereby the sixteenth invention makes it possible to provide an image forming apparatus equipped with the fixing apparatus which is capable of preventing stripes from being traced due to slide contact between both the ends of each upper rotary body and the recording medium which has been subjected to the fixed treatment while passing between the pairs of sheet discharge rotary bodies.

Moreover, the seventeenth invention according to the present application is configured so that the upper rotary bodies having surfaces made mainly of a fluoroplastic material are brought into slide contact with the recording medium which has been subjected to the fixing treatment while passing between the pairs of sheet discharge rotary bodies, whereby the seventeenth invention makes it possible to provide an image forming apparatus equipped with the fixing apparatus which is configured to enhance an efficiency to prevent the semi-melted developer from adhering to the surfaces of the upper rotary bodies from the recording medium which has been subjected to the fixing treatment.

In addition, the eighteenth invention according to the present application is configured so that the recording medium which bears a non-fixed image is subjected to the fixing treatment by heating with the ceramic heater while passing between the film and the press rotary body, and then nipped, conveyed and discharged out of the fixing apparatus main body with the sheet discharge rotary bodies according to the tenth to seventeenth inventions according to the present application, whereby the eighteenth invention makes it possible to provide an image forming apparatus which is equipped with the fixing apparatus exhibiting the effects of the first to eighth inventions and configured to speed the image forming process.

What is claimed is:

1. A fixing apparatus which performs a fixing treatment of a recording medium bearing a non-fixed image on a surface of the recording medium by heating said recording medium with heating means while passing the recording medium between a fixing rotary body and a press rotary body which are in press contact with each other and rotatable comprising:

discharge rotary body pair which are to be brought into press contact with each other through said recording medium, for nipping, conveying and discharging said recording medium out of the fixing apparatus after the fixing treatment, said discharge rotary body pair having an upper rotary body to be brought into contact with a surface of said recording medium and a lower rotary body to be brought into contact with another surface of said recording medium, wherein a conveying direction of said upper rotary body has a tilt to a widthwise direction of said recording medium relative to a conveying direction of said recording medium.

2. The fixing apparatus according to claim 1, wherein a recording medium conveying speed between the upper rotary body and the lower rotary body is set higher than a recording medium conveying speed between the fixing rotary body and the press rotary body.

3. The fixing apparatus according to claim 1 or 2, wherein a rotating axial direction of the upper rotary body is set in a direction which is included in a plane parallel to the surface of the recording medium and inclined relative to rotating axial directions of the fixing rotary body and the press rotary body.

4. The fixing apparatus according to claim 1 or 2, wherein the upper rotary body has a through bore which is formed therein to have an inside diameter continuously enlarged from one end to the other end in a rotating axial direction, and into which a cylindrical shaft body which rotatably supports the upper rotary body is inserted, and wherein the shaft body has an outside diameter not exceeding a small diameter of the through bore.

5. The fixing apparatus according to claim 1 or 2, wherein the upper rotary body is formed to have an outside diameter which is continuously enlarged from one end to the other end in a rotating axial direction of the upper rotary body.

6. The fixing apparatus according to claim 1 or 2, comprising a plurality of discharge rotary body pairs having upper rotary bodies and lower rotary bodies, wherein the upper rotary bodies and the lower rotary bodies are arranged symmetrically or nearly symmetrically with regard to a center in rotating axial directions of the fixing rotary body and the press rotary body.

7. The fixing apparatus according to claim 1 or 2, wherein the upper rotary body has an outer circumferential surface having smooth forms at both ends in its rotating axial direction.

8. The image forming apparatus according to claim 1 or 2, wherein the upper rotary body has a surface which is made mainly of a fluoroplastic material.

9. The fixing apparatus according to claim 1 or 2, wherein the fixing rotary body is an endless belt shaped heat resistant film, and the heating means is a ceramic heater having a heating member which is disposed on a surface of a substrate made mainly of a ceramic material to generate heat while receiving an electric power from an electric power source, and a temperature detecting body which is disposed in contact with or in the vicinity of an other surface of the substrate.

10. An image forming apparatus for making a latent image formed and borne on an image bearing member into a visible image with a developer, transferring said visible image to a surface of a recording medium for forming a non-fixed image on said surface, and then recording said non-fixed image on said recording medium as a fixed image comprising:

the fixing apparatus according to claim 1.

11. The image forming apparatus according to claim 10, wherein a recording medium conveying speed between an upper rotary body and a lower rotary body is set higher than a recording medium conveying speed between a fixing rotary body and a press rotary body.

12. The image forming apparatus according to claim 10 or 11, wherein a rotating axial direction of the upper rotary body is set on a plane in parallel with the surface of the recording medium and inclined relative to rotating axial directions of a fixing rotary body and a press rotary body.

13. The image forming apparatus according to claim 10 or 11, wherein the upper rotary body has a through bore which is formed therein to have an inside diameter continuously enlarged from one end to the other end in its rotating axial direction, and into which a cylindrical shaft body which rotatably supports the upper rotary body is inserted, and wherein the shaft body has an outside diameter not exceeding a small diameter of the through bore.

14. The image forming apparatus according to claim 10 or 11, wherein the upper rotary body is formed to have an outside diameter which is continuously enlarged from one end to the other end in its rotating axial direction.

15. The image forming apparatus according to claim 10 or 11, comprising a plurality of discharge rotary body pairs having upper rotary bodies and lower rotary bodies, wherein the upper rotary bodies and the lower rotary bodies are arranged symmetrically or nearly symmetrically with regard to a center in rotating axial directions of the fixing rotary body and the press rotary body.

16. The image forming apparatus according to claim 10 or 11, wherein the upper rotary body is formed to have smooth outer circumferential surfaces at both ends in its rotating axial direction.

17. The image forming apparatus according to claim 10 or 11, wherein the upper rotary body has a surface which is made mainly of a fluoroplastic material.

18. The image forming apparatus according to claim 10 or 11, wherein the fixing rotary body is an endless belt shaped heat resistance film, the press rotary body is a cylindrical press roller, and the heating means is a ceramic heater having a heat generating member which is disposed on a surface of a substrate made mainly of a ceramic material to generate heat while receiving an electric power from an electric power source and a temperature detecting body which is disposed in contact with or in the vicinity of another surface of the substrate.

19. A sheet conveying unit comprising:

fixing means which performs a fixing treatment of a non-fixed image formed on a sheet by heating the sheet, said fixing means having a fixing rotary body for conveying the sheet; and a pair of rotary bodies which nip and convey the sheet which has been subjected to the fixing treatment by said fixing means, wherein one rotary body of said pair of rotary bodies to be brought into contact with a surface of the sheet on which the image is formed rotates about an axis which is not parallel to a rotational axis of said fixing rotary body so that said one rotary body applies a conveying force to the sheet in a direction having a tilt to a widthwise direction of the sheet relative to a conveying direction of the sheet.

20. The sheet conveying unit according to claim 19, wherein said pair of rotary bodies are disposed adjacently to said fixing means.

21. The sheet conveying unit according to claim 19, wherein said fixing means comprises a press rotary body which presses the sheet to said fixing rotary body.

22. The sheet conveying unit according to claim 19, wherein said rotary bodies apply to the sheet a conveying force in a direction which is inclined relative to a conveying direction in the fixing means.

23. The sheet conveying unit according to claim 19, wherein said fixing means has a heating body disposed on an inner circumferential surface of an endless belt shaped film and heats the sheet through said film while the sheet is passing on an outer circumferential surface of the film.

24. The sheet conveying unit according to claim 19, comprising said rotating bodies in a plurality of pairs which are arranged in a direction perpendicular to a conveying direction of the sheet.

25. The sheet conveying unit according to claim 19, wherein one rotary body of said pair of rotary bodies to be brought into contact with the surface of the sheet on which the image is formed has a diameter in its middle which is larger than a diameter at both ends thereof.

26. The sheet conveying unit according to claim 19, wherein one rotary body of said pair of rotary bodies to be brought into contact with the surface of the sheet on which the image is formed rotates about an axis inclined toward a conveying direction of the sheet.

27. A sheet conveying unit comprising:

fixing means which performs a fixing treatment of a non-fixed image formed on a sheet by heating the sheet, said fixing means having a fixing rotary body for conveying the sheet; and a pair of rotary bodies which nip and convey the sheet subjected to the fixing treatment by said fixing means, wherein one rotary body of said pair of rotary bodies applies a conveying force to the sheet in a direction parallel to the surface of the sheet and inclined relative to a conveying direction of the sheet.

28. The sheet conveying unit according to claim 27, wherein one rotary body of said pair of rotary bodies to be brought into contact with the surface of the sheet on which the image is formed has a through bore formed therein having an inside diameter continuously enlarged from one end to the other end and is rotatably supported by a shaft body inserted into said through bore.

29. The sheet conveying unit according to claim 27, wherein one rotary body of said pair of rotary bodies to be brought into contact with the surface of the sheet on which the image is formed has an outside diameter continuously enlarged from one end to the other end.

30. The sheet conveying unit according to claim 27, wherein said pair of rotary bodies are disposed adjacently to said fixing means.

31. The sheet conveying unit according to claim 27, wherein said fixing means comprises a press rotary body which presses the sheet to said fixing rotary body.

32. The sheet conveying unit according to claim 27, wherein said fixing means has a heating body disposed on an inner circumferential side of a rotating endless belt shaped film and heating the sheet passing on an outer circumferential surface of the film through said film.

33. The sheet conveying unit according to claim 27, comprising said rotary bodies in a plurality of pairs which are arranged in a direction perpendicular to the conveying direction.

34. The sheet conveying unit according to claim 19, comprising means for forming the non-fixed image on the sheet upstream said fixing means.

35. The sheet conveying unit according to claim 27, comprising means for forming the non-fixed image on the sheet upstream said fixing means.

36. The fixing apparatus according to claim 1 or 2, wherein the fixing rotary body is an endless belt shaped heat resistant film, and the heating means heats the recording medium by using an electromagnetic induction.

37. The image forming apparatus according to claim 10 or 11, wherein the fixing rotary body is an endless belt shaped heat resistant film, the press rotary body is a cylindrical press roller, and the heating means heats the recording medium by using an electromagnetic induction.

38. The sheet conveying unit according to claim 23, wherein said heating body heats the sheet by using an electromagnetic induction.

39. The sheet conveying unit according to claim 32, wherein said heating body heats the sheet by using an electromagnetic induction.

* * * * *

UNITED STATES PATENT AND TRADEMARK OFFICE

CERTIFICATE OF CORRECTION

PATENT NO. : 6,330,419 B1
DATED : December 11, 2001
INVENTOR(S) : Atsushi Sano et al.

It is certified that error appears in the above-identified patent and that said Letters Patent is hereby corrected as shown below:

Column 1,
Line 38, "beared" should read -- borne --.
Line 48, "an" should be deleted.

Column 3,
Line 54, "body" should read -- body, --.

Column 4,
Line 67, "a" should read -- an --.

Column 9,
Line 51, "of" should be deleted.

Column 11,
Line 2, "aside" should read -- a side --.
Line 27, "values" should read -- value --.
Line 55, "order" should read -- other --.

Signed and Sealed this

Sixteenth Day of April, 2002

*Attest:*

*Attesting Officer*

JAMES E. ROGAN
*Director of the United States Patent and Trademark Office*